United States Patent [19]

Shimai

[11] 4,404,722

[45] Sep. 20, 1983

[54] APPARATUS FOR FORMING A SPACE SECTION IN A PAIR OF CONTINUOUS SLIDE FASTENER STRINGERS

[75] Inventor: Hideo Shimai, Namerikawa, Japan

[73] Assignee: Yoshida Kogyo, K.K., Tokyo, Japan

[21] Appl. No.: 258,566

[22] Filed: Apr. 29, 1981

[30] Foreign Application Priority Data

May 1, 1980 [JP] Japan ..... 55-58154

[51] Int. Cl.[3] ..... B23P 19/04

[52] U.S. Cl. ..... 29/33.2; 29/408; 29/766

[58] Field of Search ..... 29/33.2, 33 R, 408, 29/34 A, 766, 770

[56] References Cited

U.S. PATENT DOCUMENTS

| | | | |
|---|---|---|---|
| 2,987,809 | 6/1961 | Burbank | 29/408 |
| 3,005,581 | 10/1961 | Burbank | 29/766 X |
| 3,128,543 | 4/1964 | Pasciano | 29/408 |
| 3,225,430 | 12/1965 | Fasciano | 29/33 R |
| 3,456,328 | 7/1969 | Wasko | 29/33.2 X |
| 3,490,133 | 1/1970 | Glindmeyer et al. | 29/33.2 X |
| 3,570,104 | 3/1971 | Jensen | 29/766 X |
| 3,611,538 | 10/1971 | Takamatsu | 29/33.2 |
| 3,763,546 | 10/1973 | Perlman | 29/33.2 X |
| 3,852,869 | 12/1974 | Shimai | 29/33.2 X |
| 3,863,323 | 2/1975 | Talamatsu | 29/33.2 X |
| 3,913,432 | 10/1975 | Thaler et al. | 29/33.2 X |
| 3,958,319 | 5/1976 | Takamatsu | 29/408 |
| 4,232,438 | 11/1980 | Takahashi et al. | 29/408 |

FOREIGN PATENT DOCUMENTS

| | | | |
|---|---|---|---|
| 1561401 | 3/1969 | France | 29/33 R |
| 2021681 | 12/1979 | United Kingdom | 29/766 |

*Primary Examiner*—William R. Briggs

*Attorney, Agent, or Firm*—Hill, Van Santen, Steadman & Simpson

[57] ABSTRACT

An apparatus for forming an element-free gap or space section in a pair of continuous slide fastener stringers. In the apparatus, a support table has a guide groove for receiving the pair of fastener stringers along a longitudinal path. A pair of guide plates is disposed one on each side of the guide groove and extends thereover toward each other to define with the guide groove a guide channel. A pressure pad is vertically movable around a stationary die in the support table for clamping with the guide plate a pair of tapes. A punch has a sharp cutting edge so that, as the punch is moved toward the stationary die, the cutting edge enters a relatively small clearance between adjacent tape edges to cut a chain of interengaged coupling elements only at tape-side leg portions while the pair of continuous slide fastener stringers is simply placed in and along the guide channel. An ejector is disposed beneath the punch and is upwardly movable together with the punch to pull the cut coupling elements out of stitches holding the coupling elements to the tapes while the latter are clamped between the pressure pad and the guide plates without pulling the tapes laterally apart from each other.

7 Claims, 11 Drawing Figures

APPARATUS FOR FORMING A SPACE SECTION IN A PAIR OF CONTINUOUS SLIDE FASTENER STRINGERS

BACKGROUND OF THE INVENTION

1. Field of the Invention

The present invention relates generally to the production of slide fasteners, and more particularly to an apparatus for forming a space section devoid of coupling elements in a pair of continuous slide fastener stringers.

2. Prior Art

A number of devices for the purpose described above are known in which a chain of interengaged filamentary coupling elements attached by stitches to a pair of tapes along their adjacent longitudinal edges is cut for a length corresponding to the length of an element-free gap or space section by means of a coacting punch and die. It has been a common practice to this end that the tapes are pulled apart locally in order to allow the punch to enter between the adjacent tape edges so that the cutting of the coupling elements is accomplished without cutting the tapes. However, pulling the tapes locally often makes the tapes to become unrecoverably deformed or otherwise damaged. Further, because of this tape pulling, an increased rate of production with the prior apparatus is difficult to achieve. Such prior art is exemplified by U.S. Pat. No. 3,225,430, issued Dec. 28, 1965, and French Pat. No. 1,561,401, issued Mar. 28, 1969.

SUMMARY OF THE INVENTION

According to the present invention, a support table has a guide groove for receiving a pair of continuous slide fastener stringers along a longitudinal path. A pair of guide plates is disposed one on each side of the guide groove and extends thereover toward each other to define with the guide groove a guide channel. A pressure pad is vertically movable around a stationary die in the support table for clamping the tapes between the pressure pad and the guide plates. A punch has a sharp cutting edge so that, as the punch is moved toward the stationary die, the cutting edge enters a relatively small clearance between adjacent tape edges to cut a chain of interengaged coupling elements only at tape-side leg portions while the pair of continuous slide fastener stringers is simply placed in and along the guide channel. An ejector is disposed beneath the punch and is upwardly movable together with the punch to pull the cut coupling elements out of stitches holding the coupling elements to the tapes while the latter are clamped between the pressure pad and the guide plates without pulling the tapes laterally apart from each other.

An object of the present invention to provide an apparatus in which an element-free gap or space section can be formed in a pair of continuous slide fastener stringers acurately without deforming or otherwise damaging a pair of stringer tapes.

Another object of the invention is to provide such an apparatus which enables an increased degree of productivety.

Still another object of the invention is to provide such an apparatus which can be automated easily and less costly.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
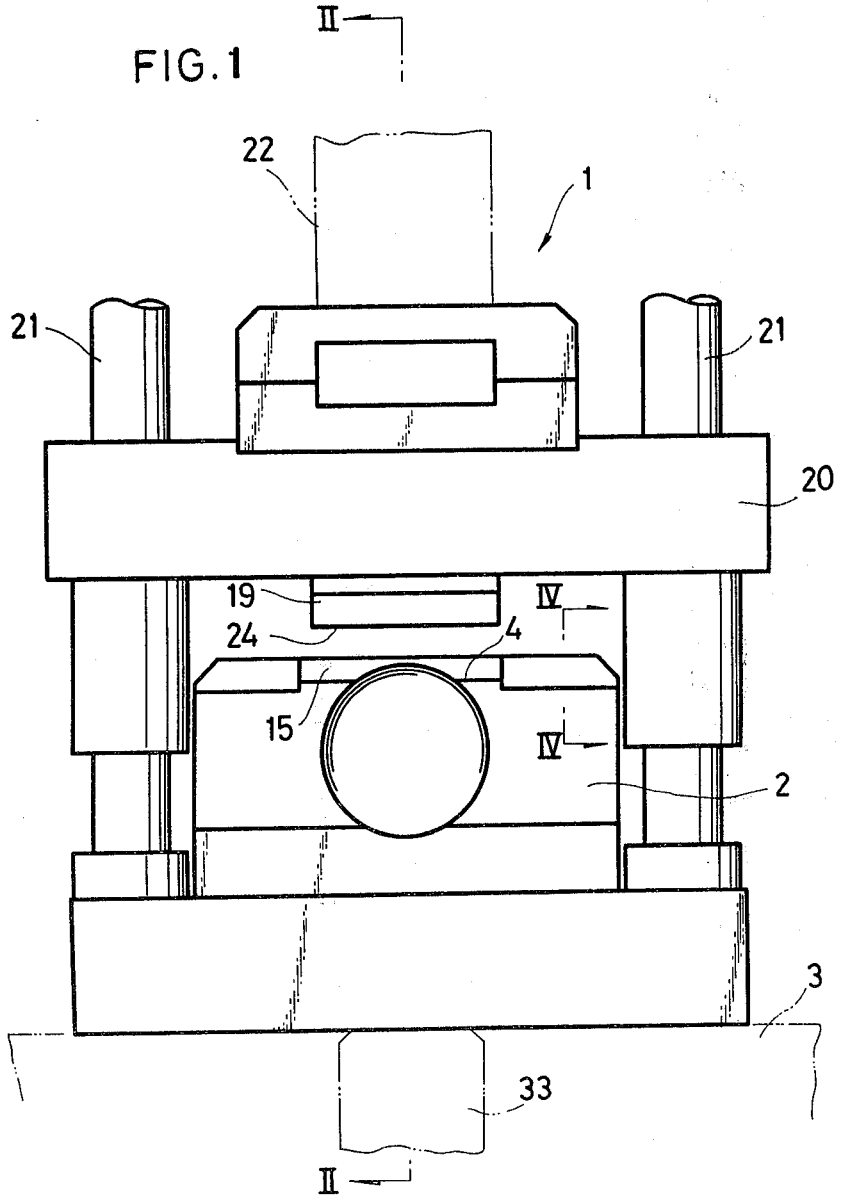
FIG. 1 is a front elevational view of an apparatus embodying the present invention.
Figure 2:
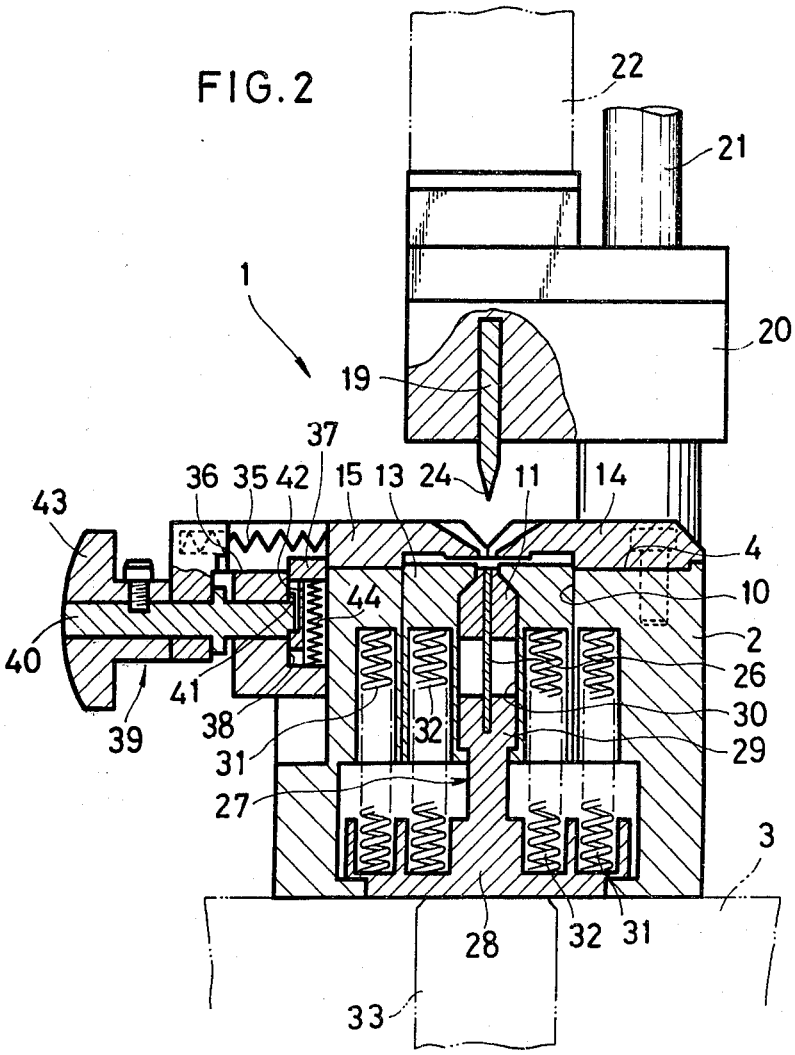
FIG. 2 is a cross-sectional view taken along line II—II of FIG. 1.

The principles of the present invention are particularly useful when embodied in an apparatus such as shown in FIGS. 1 and 2, generally indicated by the numeral 1.

Figure 11:
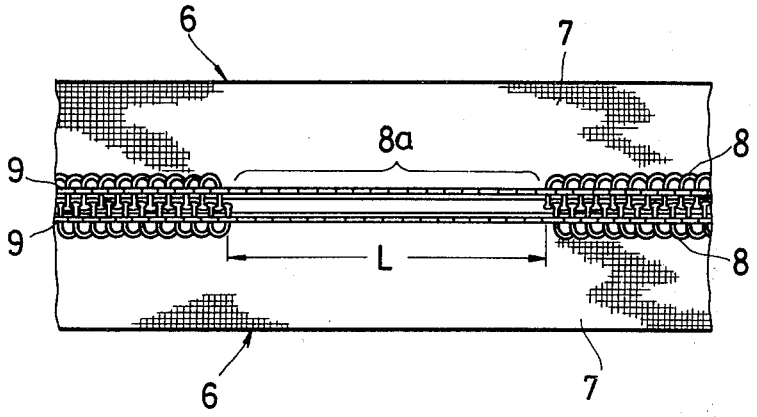
FIG. 11 is a fragmentary plan view of a pair of continuous slide fastener stringers having an element-free gap or space section formed by the apparatus.

The apparatus 1 comprises a support table 2 mounted on a frame 3 and having in its top surface 4 a guide groove 5 (FIGS. 3 and 4) for receiving and guiding a pair of interengaged continuous slide fastener stringers 6,6 (FIG. 11) (hereinafter referred to as "fastener stringers") along a longitudinal path. The fastener stringers 6,6 include a pair of tapes 7,7 carrying along their adjacent longitudinal edges a pair of rows of interengaged continuous filamentary coupling elements 8,8 attached by stitches 9,9 to the respective tapes 7,7. As shown in FIG. 4, the guide groove 5 is composed of a pair of spaced shallow groove portions *5a,5a* for receiving the tapes 7,7, respectively, and a deep groove portion *5b* extending between the shallow groove portions *5a,5a* for receiving the interengaged coupling element rows 8,8.

The support table 2 has a vertical bore 10 (FIG. 2) opening at an upper end to the guide groove 5 substantially centrally of its length, such an upper end or mouth of the bore 10 being transversely coextensive with the guide groove 5.

Figure 3:
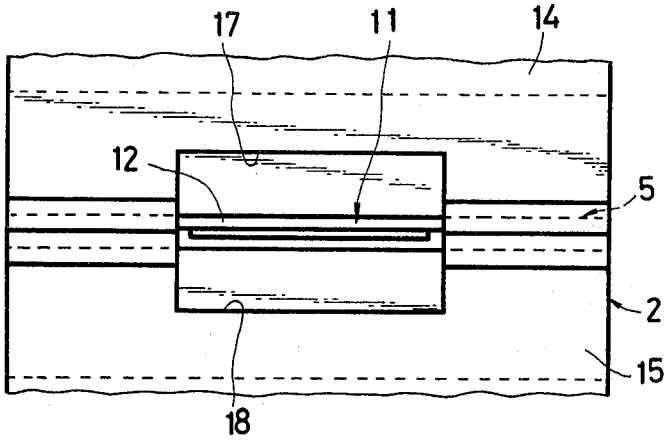
FIG. 3 is an enlarged fragmentary plan view of a support table with a pair of guide plates.
Figure 4:
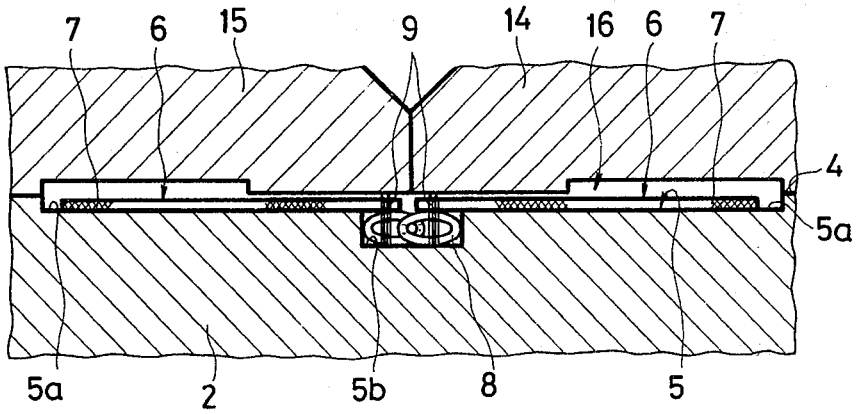
FIG. 4 is an enlarged fragmentary cross-sectional view taken along line IV—IV of FIG. 1.

A stationary die 11 is disposed in the bore 10 of the support table 2 it being supported by the support table at its ends, as best shown in FIG. 3. The stationary die 11 has an elongate top surface 12 (FIGS. 3, 6–8) aligned horizontally with a bed of the deep groove portion *5b* for supporting the interengaged coupling elements 8,8 along a length slightly greater than the length L of an element-free or space section *8a* (FIG. 11) to be formed.

A pressure pad 13 is vertically movably disposed along the longitudinal sides of the stationary die 11 in the bore 10 of the support table 2, as shown in FIG. 2, for a purpose described below.

Figure 7:
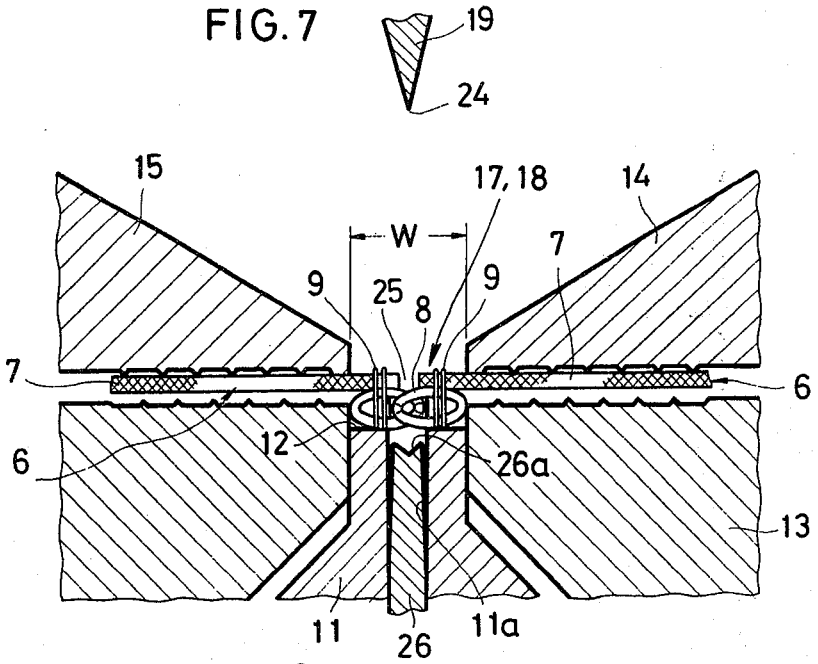
FIGS. 7 through 10 are cross-sectional detail views showing the manner in which an element-free gap or space section is formed in a pair of continuous slide fastener stringers.

A pair of first and second guide plates 14,15 is supported on the support table 2 one on each side of the guide groove 5 and extends thereover toward each other so as to define with the guide groove 5 a guide channel 16 (FIG. 4) for the fastener stringers 6,6. The first guide plate 14 is fixed to the support table 2, and the second guide plate 15 is movable toward and away from the first guide plate 14 for a purpose described below. The first and second guide plates 14,15 have a pair of transversely aligned cutouts 17,18 (FIG. 3) in and along their opposed edges so as to jointly define an aperture aligned vertically with the top surface 12 of the stationary die 11 as the second guide plate 15 is in advanced position close to the first guide plate 14. The aperture 17,18 has a predetermined width W (FIG. 7). The pressure pad 13 is upwardly movable toward the guide plates 14,15 for clamping therewith portions of the tapes 7,7 around a space-section length L of the interengaged coupling element rows 8,8 supported on the top surface 12 of the stationary die 11. The guide plates 14,15 and the pressure pad 13 have on their clamping faces a multiplicity of small projections 13*a* (FIGS. 8–10) that serve to prevent the clamped tapes 7,7 from being slipped or displaced on the clamping surfaces.

A punch 19 (FIGS. 1 and 2) is carried by a punch holder 20 vertically movably mounted on a pair of parallel posts 21,21 fixed to the frame 3 of the apparatus 1. The punch holder 20 is adapted to be connected to an upper plunger 22 for vertical motion. The punch 19 has a sharp cutting edge 24 so that, as the punch holder 20 with the punch 19 is lowered toward the stationary die 11, the cutting edge 24 enters a relatively small clearance 25 (FIG. 7) between adjacent tape edges, through the aperture (17,18) of the guide plates 14,15, to cut a space-section length L of the interengaged rows of the coupling elements 8,8 only at their tape-side leg portions 8*b* (FIGS. 8–10) while the pair of the fastener stringers 6,6 is simply placed in and along the guide channel 16 (FIG. 4).

An ejector 26 extends through a slot 11*a* (FIG. 7) in the stationary die 11 and is aligned vertically with the cutting edge 24 of the punch 19. The ejector 26 is upwardly movable together with the punch 19 relative to the stationary die 11 for pulling the cut coupling elements 8 out of the stitches 9,9 while the tapes 7,7 are clamped between the pressure pad 13 and the guide plates 14,15. The ejector 26 and the pressure pad 13 are operatively connected by a drive mechanism (described below) so as to be moved in timed relation to each other.

Figure 8:
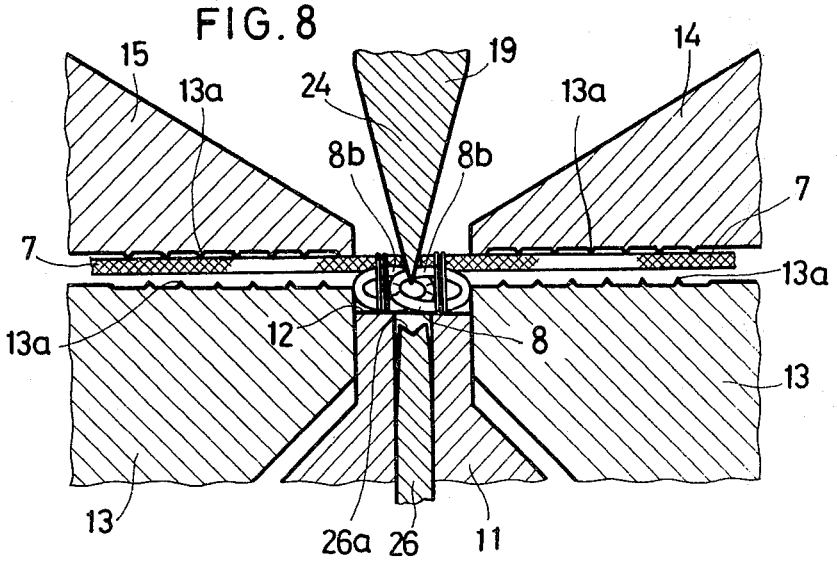

As best shown in FIG. 2, the drive mechanism comprises an ejector holder 27 disposed within the support table 2 and vertically movable between an upper position in which the ejector 26 is raised from the stationary die 11 (FIG. 10) and a lower position in which the ejector 26 is retracted into the stationary die 11 (FIGS. 7 and 8). The ejector holder 27 has a base portion 28 disposed beneath the pressure pad 13 and a head portion 29 projecting upwardly from the base portion 28 into a vertical channel 30 (FIGS. 2 and 5) of the pressure pad 13 in which channel the stationary die 11 is disposed. The head portion 29 is slidable vertically in the vertical channel 30 beneath the stationary die 11 and is fixed to a bottom end of the ejector 26. The mechanism further comprises a pair of first and second set of compression springs 31,32. The first set of compression springs 31 is mounted between the support table 2 and the base portion 28 of the ejector holder 27 to urge the latter to its lower position, while the second set of compression springs 32 is mounted between the pressure pad 13 and the base portion 28 of the ejector holder 27 to urge the pressure pad 13 and the ejector holder 27 away from each other. The pressure pad 13 has a pair of opposed flanges 30*a*,30*a* (FIG. 5) at a bottom end of the vertical channel 30, and the head portion 29 has a pair of jaws 34,34 (FIG. 5) engageable with the respective flanges 30*a*,30*a*, whereby the extent to which the pressure pad 13 and the ejector holder 27 are moved relative to each other is restricted; that is, the lower position of the pressure pad 13 is determined by the lower position of the ejector holder 27. The drive mechanism further includes a lower plunger 33 adapted to be driven, by a suitable drive source (not shown), for actuating the ejector holder 27 to be moved from the lower position (FIG. 2) to the upper position (FIG. 5) against the bias of the first and second sets of compression springs 31,32, causing the pressure pad 13 to be moved upwardly from the position of FIGS. 7 and 8 in which a pair of top surfaces 13*a*,13*a* of the pressure pad 13 is aligned with the respective beds of the shallow groove portions 5*a*,5*a*, to the position of FIGS. 9 and 10 in which the tapes 7,7 are clamped between the pressure pad 13 and the guide plates 14,15.

The cutting edge 24 of the punch 19 has a length extensive with the ejector 26, longitudinally of the longitudinal path of the pair of the fastener stringers 6,6, and equal to the length L of a space section 8*a* (FIG. 11) to be formed. The ejector 26 has a longitudinal notched upper edge 26*a* (FIGS. 7–10).

Figure 6:
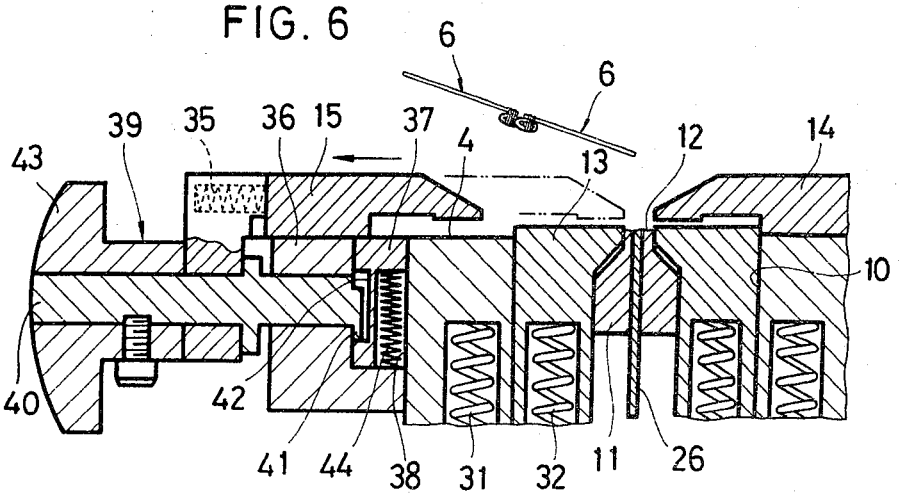
FIG. 6 is a cross-sectional detail view showing the manner in which a pair of continuous slide fastener stringers to be gapped is set on the apparatus.

As shown in FIG. 2, the second or movable guide plate 15 is urged by an extension spring 35 away from the first or fixed guide plate 14, i.e. leftwardly, the extension spring 15 being connected at one end to the second guide plate 15 and at the other end to a block 36 fixed to the support table 2. A stop 37 is supported on the block 36 and is movable between an upper position (FIG. 2) and a lower position (FIG. 6). In its upper position the stop 37 projects above the top surface 4 of the support table 2 to prevent the second guide plate 15 from being moved away from the first guide plate 14. In its lower position the stop 37 is retracted below the top surface 4 of the support table 2 into a vertical hole 38 in the block 36 to allow the second guide plate 15 to be moved away from the first guide plate 14. The vertical movement of the stop 37 between its upper and lower positions is accomplished by turning a handle 39. The handle 39 includes a cam shaft 40 extending through an unnumbered horizontal hole of the block 36, a cam 41 formed on an inner end of the cam shaft 40 integrally therewith and engageable with a recess 42 of the stop 37, and a knob 43 mounted on an outer end of the cam shaft 40 for rotating the cam 41. The stop 37 is urged to its upper position by a compression spring 44.

In initial loading operation, as the handle 39 is turned through 180° in FIG. 2, the stop 37 is forced downwardly by the cam 41 to its retracted position (FIG. 6) against the bias of the compression spring 44. The second guide plate 15 is moved, under the force of the extension spring 35, from its phantom line position to its solid line position to expose the guide groove 5 widely. A pair of the continuous slide fastener stringers 6,6 is placed in the guide groove 5 such that a pair of the interengaged coupling element rows 8,8 is received in the deep groove portion 5*b*, with the tapes 7,7 received in the respective shallow groove portions 5*a*,5*a*. Then the second guide plate 15 is returned to its original position (phantom line position in FIG. 6) by hand. With the second guide plate 15 held in the original position by hand, as the handle 39 is turned for another 180°, the stop 37 is returned to its upper position to prevent the second guide plate 15 from being moved back to the solid line position of FIG. 6.

In space-section forming operation, as shown in FIGS. 7 and 8, as the punch holder 27 is then lowered together with the punch 19 by the upper plunger 22, the cutting edge 24 of the punch 19 enters the clearance 25 between adjacent tape edges, through the aperture 17,18 of the guide plates 14,15, to cut a space-section length L of the interengaged rows of coupling elements 8,8. At that time the pair of the continuous slide fastener stringers 6,6 is simply placed in and along the guide channel 16 (FIG. 4). The downward movement of the upper plunger 22 is preset to terminate immediately after the cutting edge 24 has cut the coupling elements 8 only at tape-side leg portions **8*b* thereof (FIG. 8**).

Figure 9:
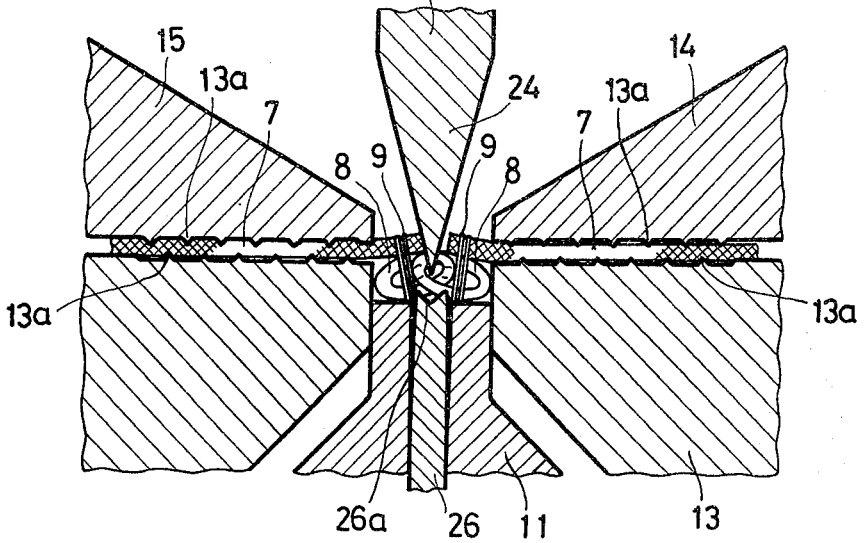

Then, as the ejector holder 27 is raised by the lower plunger 33 against the bias of the first set of compression springs 31, the ejector 26 is moved upwardly to clamp the cut coupling elements 8 between the notched upper edge **26*a* of the ejector 26 and the cutting edge 24 of the punch 19 (FIG. 9). Because of the second set of compression springs 32, this raising of the ejector holder 26 also causes the pressure pad 13 to be moved upwardly. The upward movement of the pressure pad 13 terminates when the tapes 7,7 are clamped between the pressure pad 13 and the guide plates 14,15**.

Figure 10:
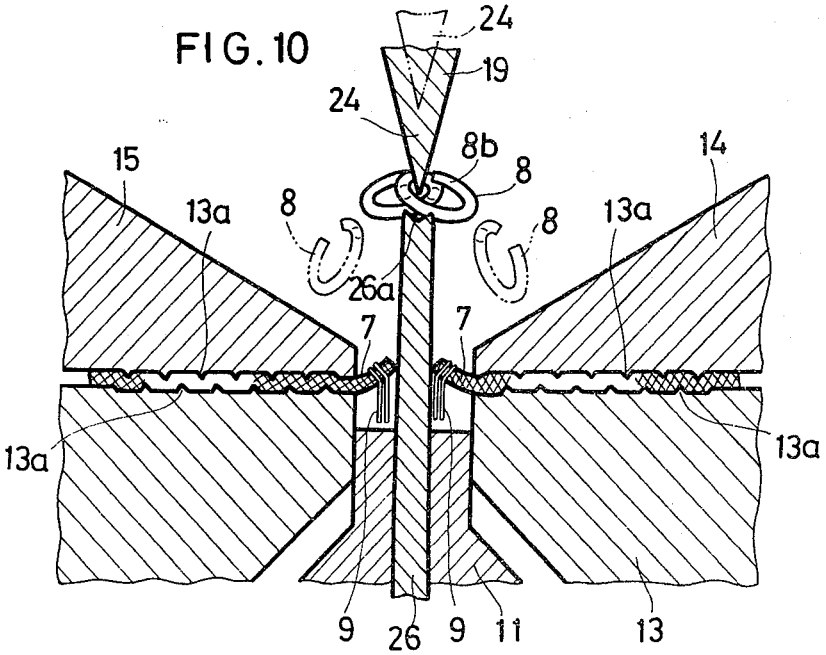

With the tapes 7,7 clamped between the pressure pad 13 and the guide plates 14,15, the ejector 26 continues to be moved upwardly together with the punch 19, pulling the cut coupling elements 8 away from the tapes 7,7, as shown in FIG. 10. At that time the upper and lower plungers 22,33 are raised at the same rate of speed. As a result, the cut coupling elements 8 are removed out of the stitches 9,9.

Then, the ejector 26 (lower plunger 33) ceases its upward movement, while the punch 19 (upper plunger 22) continues to be raised to its phantom line position (FIG. 10). Finally the cut coupling element pieces 8 remaining on the upper edge **26*a* of the ejector 26 are cleared in a known manner, for example, by means of a blower (not shown). Thus a predetermined length L of element-free gap or space section 8*a* (FIG. 11) has been formed in a pair of the continuous slide fastener stringers 6,6 with no damages to the tapes 7,7**.

Figure 5:
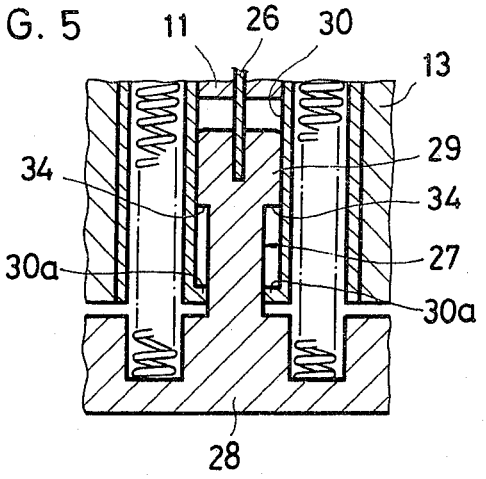
FIG. 5 is a cross-sectional detail view of an ejector and related parts.

Subsequently, as the lower plunger 33 is lowered, the ejector holder 27 is moved downwardly and the jaws 34,34 thereof (FIG. 5) are brought into engagement with the flanges **30*a*,30*a* (FIG. 5). With continued downward movement of the ejector holder 27 back to the position of FIG. 2, the pressure pad 13 is returned to the position of FIGS. 2, 7 and 8, releasing the tapes 7,7 so that the pair of continuous slide fastener stringers 6,6 can be fed, for a desired slide fastener length, for a subsequent space section 8*a* (FIG. 11) to be formed. Preferably, that feeding of the pair of continuous slide fastener stringers 6,6** is accomplished automatically by means of a suitable feed device (not shown).

With this arrangement, it is absolutely unnecessary to deflect the tapes 7,7 laterally away from each other during the space-section forming operations. Accordingly, it is possible to form a space section **8*a* devoid of coupling elements 8 accurately with no damage to the tapes 7,7**.

Since most main parts are moved simply vertically, the apparatus 1 can be automated easily and can be operated at high speed. Further, the ejector 26 and the pressure pad 13 are moved by one and the same actuating member (lower plunger 33) with no special actuating member just for the pressure pad 13, making the apparatus 1 simple in construction and hence inexpensive.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for forming a space section devoid of coupling elements in a pair of continuous slide fastener stringers including a pair of tapes carrying along their inner longitudinal edges a pair of rows of interengaged continuous coupling elements attached by stitches to the respective tapes, said apparatus comprising:

(a) a support table having in its top surface a guide groove for receiving the pair of continuous slide fastener stringers along a longitudinal path;

(b) a stationary die disposed in said support table and having a top surface for supporting the interengaged coupling element rows along a length corresponding to the length of the space section to be formed;

(c) a pair of guide plates disposed one on each side of said guide groove and extending thereover toward each other, said guide plates having an aperture registering with said top surface of said stationary die;

(d) a pressure pad vertically movably disposed around said stationary die in said support table for clamping with said guide plates portions of the tapes around said length of the interengaged coupling element rows supported on said top surface of said stationary die;

(e) a punch vertically movable toward and away from said stationary die and having a sharp cutting edge locatable to project through said aperture of said guide plates into said longitudinal path of the pair of continuous slide fastener stringers for cutting tape-side leg portions of the interengaged coupling elements supported on said top surface of said stationary die;

(f) an ejector extending vertically through said stationary die and aligned vertically with said cutting edge of said punch, said ejector being upwardly movable together with said punch relative to said stationary die for pulling the cut coupling elements out of the stitches while the tapes are clamped between said pressure pad and said guide plates; and (g) a mechanism for driving said pressure pad and said ejector to be moved in timed relation to each other.

2. An apparatus according to claim 1, said mechanism including:

(a) an ejector holder supporting said ejector and vertically slidably connected to said pressure pad and movable between an upper position in which said ejector is raised from said stationary die and a lower position in which said ejector is retracted into said stationary die;

(b) means urging said ejector holder to said lower position;

(c) means urging said ejector holder and said pressure pad away from each other; and (d) means for actuating said ejector holder to be moved from said lower position to said upper position against the bias of the first- and second-mentioned urging means, said pressure pad, as said ejector holder is moved upwardly, being moved upwardly until the tapes are clamped between said pressure pad and said guide plates.

3. An apparatus according to claim 2, said pressure pad having a vertical channel, said ejector holder having a base portion disposed beneath said pressure pad, and a head portion slidably received in said vertical channel and connected to a bottom end of said ejector.

4. An apparatus according to claim 3, said first-mentioned urging means including at least one first compression spring mounted between said support table and said base portion of said ejector holder, said second-mentioned urging means including at least one second compression spring mounted between said pressure pad and said base portion of said ejector holder.

5. An apparatus according to claim 3, said pressure pad having a pair of opposed flanges at a bottom end of said vertical channel, said head portion of said ejector holder having a pair of jaws engageable with said flanges, whereby the extent to which said pressure pad and said ejector holder are moved relative to each other is restricted.

6. An apparatus for forming a space section in a pair of slide fastener stringers, comprising:

(a) a support table having means defining a guide groove receptive of a pair of slide fastener stringers having interengaged coupling elements;

(b) a vertically movable pressure pad and a stationary die disposed in said support table and forming part of said means and defining one side of said guide groove;

(c) a vertically movable punch having an elongated cutting edge movable through an aperture in part of said means defining the other side of said guide groove disposed in registration with a series of said coupling elements for severing certain interengaged coupling elements supported on said die;

(d) an ejector movable vertically through said die and said aperture for clamping severed coupling elements against said punch for jointly removing the severed coupling elements clamped therebetween; and (e) means for simultaneously actuating said pressure pad against the tape of said stringers and said ejector against the severed coupling elements.

7. An apparatus according to claim 6, including means for selectably retracting a portion of said other side of said guide groove means to enable lateral insertion of the stringers into the apparatus.

* * * * *